US012264824B2

(12) United States Patent
Hill et al.

(10) Patent No.: US 12,264,824 B2
(45) Date of Patent: Apr. 1, 2025

(54) SPRING CLIP FOR MOUNTING A HEATING ELEMENT IN A COOKTOP

(71) Applicant: Electrolux Home Products, Inc., Charlotte, NC (US)

(72) Inventors: Daniel Hill, Springfield, TN (US); Milton Henriquez, Springfield, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 991 days.

(21) Appl. No.: 17/320,826

(22) Filed: May 14, 2021

(65) Prior Publication Data

US 2022/0364733 A1 Nov. 17, 2022

(51) Int. Cl.
*F24C 7/06* (2006.01)
*F24C 15/10* (2006.01)

(52) U.S. Cl.
CPC ..... *F24C 7/062* (2013.01); *F24C 15/102* (2013.01); *F24C 15/108* (2013.01)

(58) Field of Classification Search
CPC .... A61K 2039/5158; A61K 39/001152; A61K 39/001196; A61K 39/4611; A61K 39/464452; A61K 39/464496; A61P 35/00; C07K 14/4748; C07K 14/7051; C07K 16/32; C07K 2317/31; C07K 2317/92; C07K 2319/00; F24C 15/102; F24C 15/108; F24C 7/062; F24C 7/067; G16B 30/20
USPC ..... 219/452.11
See application file for complete search history.

(56) References Cited

U.S. PATENT DOCUMENTS

| | | | | |
|---|---|---|---|---|
| 4,189,633 | A * | 2/1980 | Skinner | F24C 15/102 219/407 |
| 5,549,098 | A | 8/1996 | Bales et al. | |
| 5,859,410 | A | 1/1999 | White et al. | |
| 7,009,151 | B2 | 3/2006 | Lee | |
| 8,526,800 | B2 | 9/2013 | Fritschie et al. | |
| 9,243,808 | B2 | 1/2016 | Cabrelle et al. | |
| 9,372,003 | B2 | 6/2016 | Harward et al. | |

(Continued)

FOREIGN PATENT DOCUMENTS

| | | |
|---|---|---|
| EP | 0980194 | 2/2000 |
| EP | 2416019 | 2/2012 |
| EP | 3428540 | 1/2019 |

(Continued)

OTHER PUBLICATIONS

GE WB2X9719 Support Bracket, Amazon, 7 pages. Last accessed May 14, 2021.

*Primary Examiner* — Dana Ross
*Assistant Examiner* — James F Sims, III
(74) *Attorney, Agent, or Firm* — Chrisman Gallo Tochtrop LLP

(57) ABSTRACT

A spring clip for securing a heating element in a cooktop is provided and includes a seat portion that supports the heating element thereon. A first tab extends upwards from the seat portion from a first junction therewith and a second tab extends vertically downward from the seat portion from a second junction therewith, located remote from the first junction. A spring tab extends downward from the seat portion and is elastically biased to a resting orientation. The spring tab is deflectable upward from the resting orientation upon engagement of the spring clip against a wall below the spring clip.

20 Claims, 6 Drawing Sheets

(56) References Cited

U.S. PATENT DOCUMENTS

| | | | | |
|---|---|---|---|---|
| 9,851,108 | B2 | 12/2017 | Pille | |
| 2019/0113238 | A1* | 4/2019 | Gomez | F24C 15/105 |

FOREIGN PATENT DOCUMENTS

| | | |
|---|---|---|
| FR | 3003338 | 9/2014 |
| WO | 2012062881 | 5/2012 |

* cited by examiner

SPRING CLIP FOR MOUNTING A HEATING ELEMENT IN A COOKTOP

FIELD OF THE INVENTION

This application relates generally to a spring clip for attaching a heating element to a support box of a cooktop, and more specifically, to such a spring clip that eliminates the need for additional fasteners to attach the spring clip to the heating element and/or to the support box, and that ensures continuous seated engagement between the heating element and a cooktop plate disposed thereabove.

BACKGROUND OF THE INVENTION

Conventional cooktop appliances include clips (or similar means) to secure a heating element within a cooktop, and particularly in the case of a radiant heating element in a manner where the heating element assembly is in abutting contact with a cooktop plate thereabove. During installation, such clips are generally secured in place by additional fasteners (e.g., screws, etc.). The instant application discloses a spring clip configured to secure a heating element within a support box of a cooktop, and wherein no additional fasteners are required to secure the spring clip to the heating element and/or to the support box.

BRIEF SUMMARY

In accordance with one aspect, there is provided a spring clip for securing a heating element in a cooktop. The spring clip includes a seat portion configured to support the heating element thereon. A first tab extends upward from the seat portion from a first junction therewith, and a second tab extends vertically downward from the seat portion from a second junction therewith, located remote from the first junction. A spring tab extends downward from the seat portion and is elastically biased to a resting orientation. The spring tab is deflectable upward from the resting orientation upon engagement of the spring clip against a wall below the spring clip.

In accordance with another aspect, there is provided a cooktop including a cooktop plate having upper and underside surfaces, wherein the upper surface is configured to support a cooking vessel thereon. A support box is disposed below the cooktop plate and has a bottom wall. A heating element is positioned between the cooktop plate and the bottom wall of the support box. A spring clip biases the heating element upward against the underside surface of the cooktop plate.

The spring clip includes a seat portion on which the heating element is seated. A first tab extends upward from the seat portion from a first junction therewith, and a second tab extends vertically downward from the seat portion from a second junction therewith, located remote from the first junction. A spring tab extends downward from the seat portion and presses against the bottom wall of the support box to bias the heating element into contact with the underside surface of the cooktop plate.

In accordance with yet another aspect, there is provided a spring clip for securing a heating element in a cooktop. The spring clip includes a seat portion configured to support the heating element thereon. A first tab extends upward from the seat portion from a first junction therewith. The first tab forms an acute angle with the seat portion in a resting orientation thereof. The first tab is resiliently pivotable from the first junction to be deflectable from its resting orientation against a bias thereof, in order to install the spring clip to the heating element. A second tab extends vertically downwards from the seat portion from a second junction therewith, located remote from the first junction.

A first retention arm stands proud from the seat portion and is configured to secure the spring clip to the heating element when seated against the seat portion. A second retention arm projects from a distal end of the second tab and is configured to secure the spring clip to a wall below the spring clip. A length of the second tab defines a degree of permissible vertical movement of the spring clip, and thereby of the heating element, once installed to the wall. Further, the vertical orientation of the second tab facilitates single-axis assembly of the heating element, affixed to the spring clip, to the wall beneath the spring clip.

A spring tab extends downward from the seat portion and is elastically biased to a resting orientation thereof. The spring tab is deflectable upward from its resting orientation upon engagement against the wall below the spring clip

DESCRIPTION OF EXAMPLE EMBODIMENTS

Figure 1:
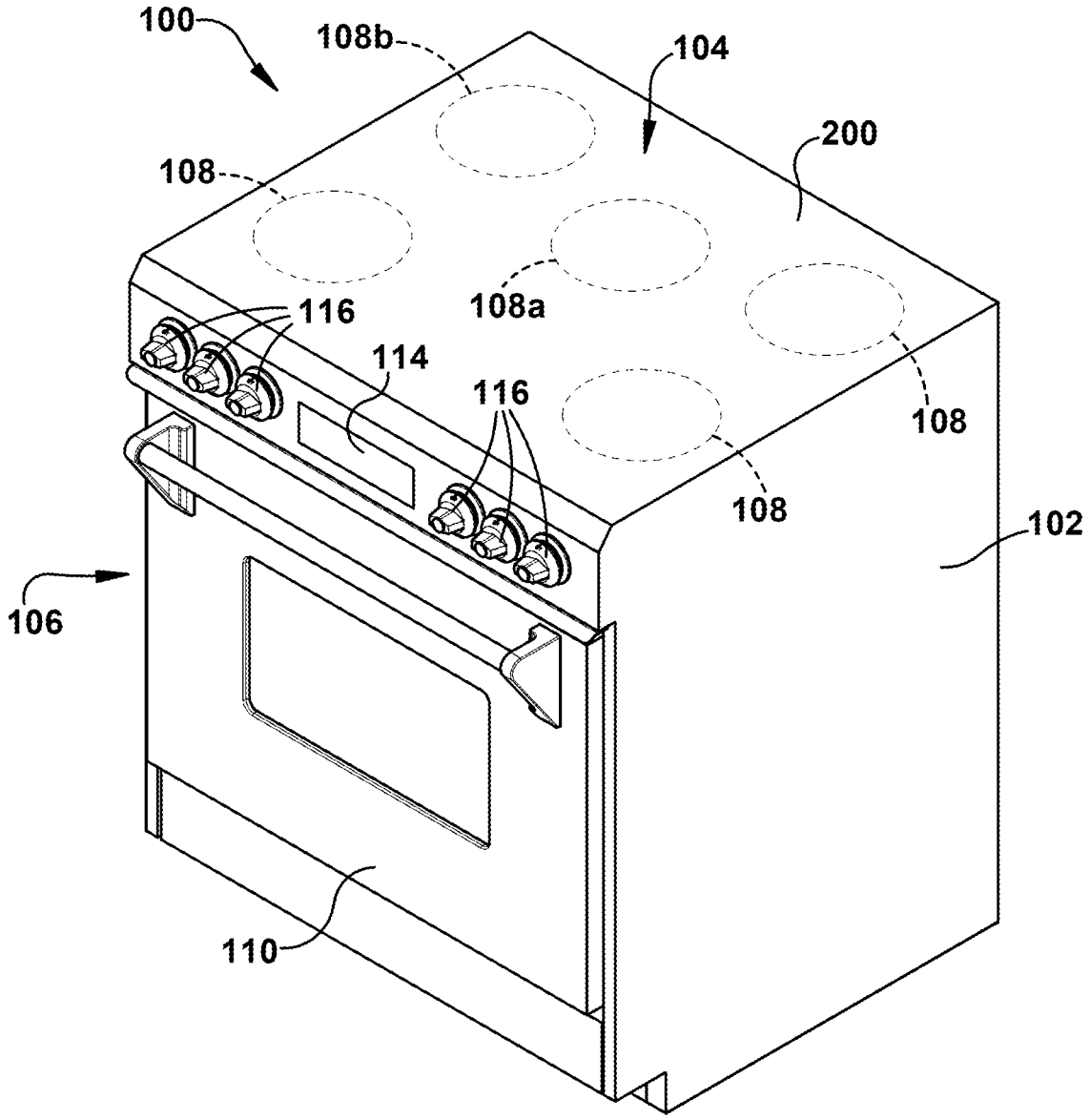
FIG. 1 is a perspective view of an example cooking appliance having a cooktop and an oven.

Referring now to the drawings, FIG. 1 depicts a cooking appliance 100 that can be a domestic appliance configured for in-home use, or an industrial appliance for commercial applications. In the illustrated example, the cooking appliance 100 includes an outer body 102 that defines an external appearance thereof. Specifically, the outer body 102 can include structural features (e.g., braces, struts, etc., not shown) as well as decorative features (e.g., outer panels adhered to the structural features). In the illustrated example, the cooking appliance 100 includes a cooktop 104 and an oven 106; however, the cooking appliance 100 need not include the oven 106 (i.e., the cooking appliance 100 can be a stand-alone—such as a drop-in—cooktop). In the illustrated embodiment the cooktop 104 is located at a top side of the cooking appliance 100 and includes at least one cooktop heating element 108, as will be described further below.

The illustrated cooking appliance 100 further includes a door 110 pivotably coupled to a front of the appliance and configured to provide selective access to the oven 106. A display panel 114 and inputs 116 (e.g., rotatable dials, slidable switches, mechanical buttons, and/or electronic buttons—e.g., touch buttons) can be disposed on a front surface of the outer body 102 (e.g., a front-control appliance). However, it is contemplated that the inputs 116 may be provided in or at a surface of the cooktop 104 (e.g. in the case of a drop-in cooktop) or in a rear control panel (e.g. as in a conventional rear-control range). During operation, a user interacts with the inputs 116 to activate/control the cooktop 104 and/or the oven 106.

Figure 2:
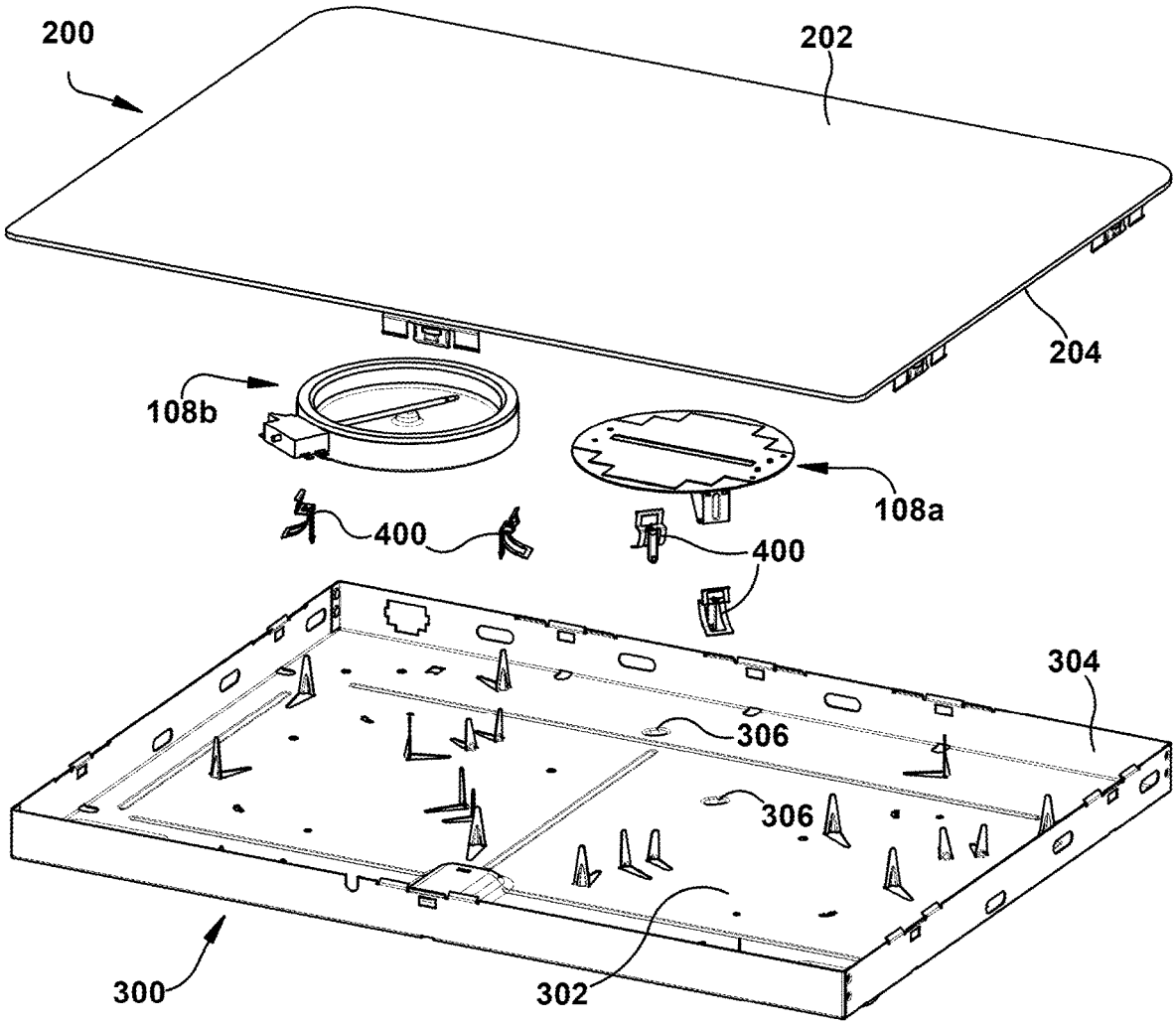
FIG. 2 is an exploded view showing select features of the cooktop of the cooking appliance shown in FIG. 1, including a cooktop plate, a support box, heating elements (i.e., a radiant element and a warmer element), and spring clips.

With respect to FIG. 2, selected features of the cooktop 104 are shown in an exploded view and removed from the outer body 102. The cooktop 104 includes a cooktop plate 200, a support box 300, heating elements 108, and spring clips 400. The cooktop plate 200 typically is made of glass and is substantially planar, however it is to be understood that the cooktop plate 200 may be constructed from other materials (i.e., ceramic or a combination of glass and ceramic). The cooktop plate 200 has opposite upper and underside surfaces 202, 204. The upper surface 202 is configured to support a cooking vessel (not shown) thereon, and may include indicia (not shown) denoting pre-determined 'heating areas' where a cooking vessel should be placed for proper heating.

The support box 300 is shown as having a shape (i.e., rectangular) complimentary to that of the cooktop plate 200. However, it is contemplated that the cooktop plate 200 and/or the support box 300 may have a shape other than rectangular. The support box 300 is shown as having a bottom wall 302 and a side wall 304 extending upward from the bottom wall 302 about its periphery. While FIG. 2 depicts the side wall 304 extending continuously about the periphery of the bottom wall 302, it is contemplated that the side wall 304 may extend (generally perpendicularly) from the bottom wall 302 about only select peripheral edges thereof. Moreover, the bottom wall 302 and the side wall 304 can be formed integrally as a single piece-part (e.g., made of metal and via sheet-metal bending), or the side wall 304 can be formed separate and distinct from the bottom wall 302 and subsequently secured thereto, e.g. using fasteners or by welding.

Figure 5A:
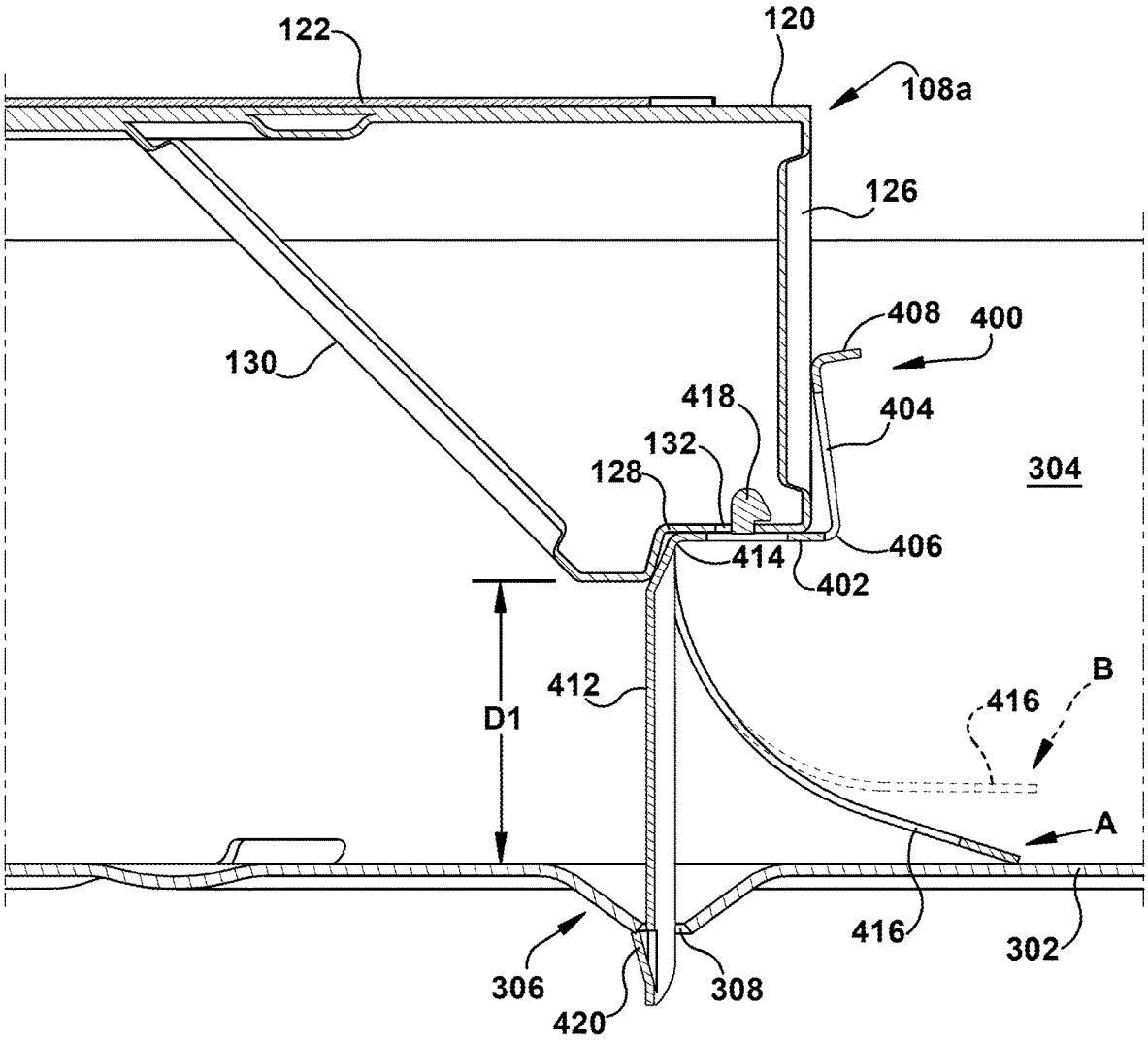
FIG. 5A is a partial cross-sectional view of the cooktop, shown in a partially assembled state.
Figure 5B:
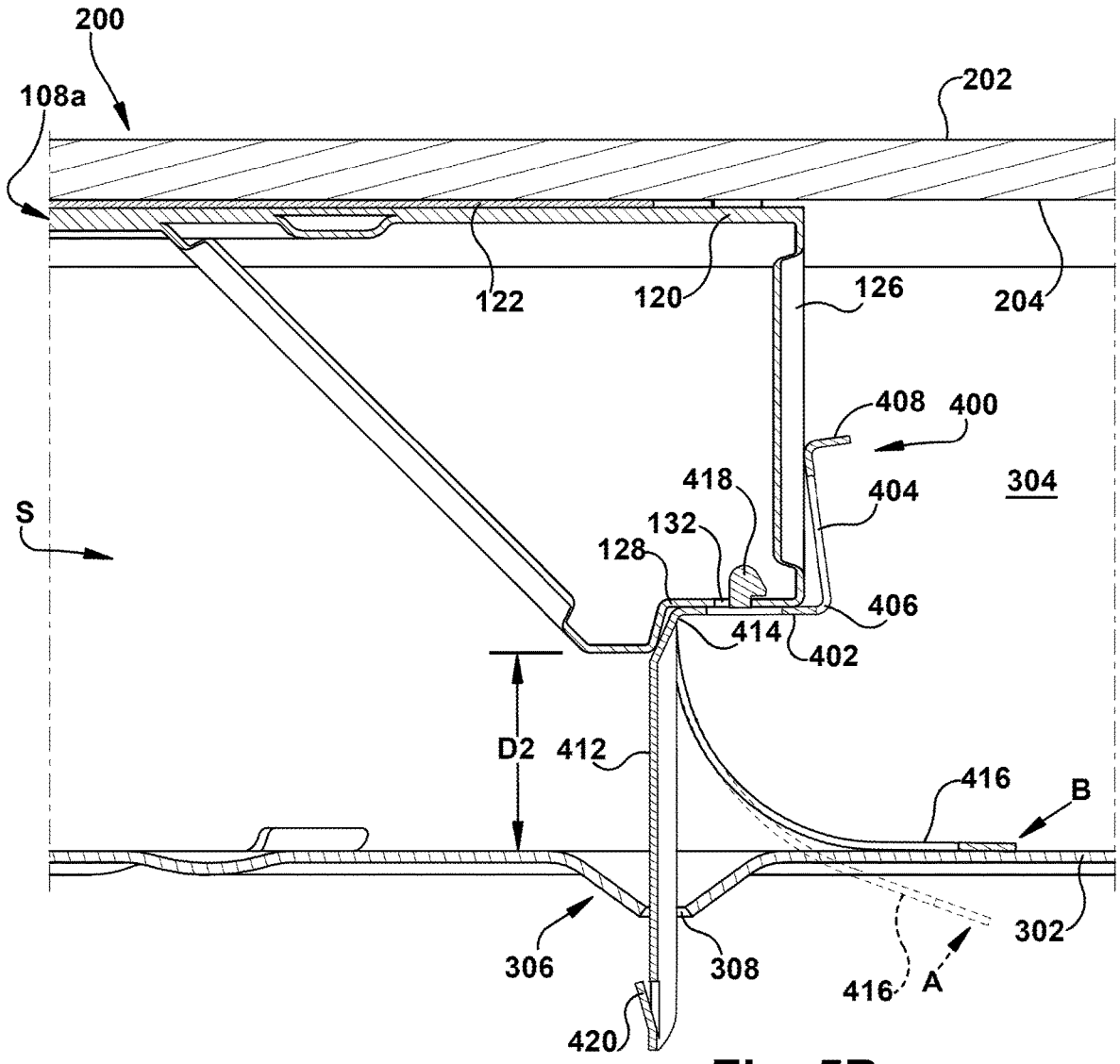
FIG. 5B is a partial cross-sectional view of the cooktop, shown in a fully assembled state.

As further shown, a plurality of reception areas 306 are formed in the bottom wall 302. In the embodiment depicted, each reception area 306 is formed as a recess or depression in the bottom wall 302 having a through-hole 308 at its center (as shown in FIGS. 5A-5B). These recesses and the associated through-holes 308 can be formed via punching as will be readily understood, and are configured to simplify installation of the warmer element 108*a* as will be discussed further below. However, it is contemplated that the reception areas 306 also may be coplanar with the rest of the bottom wall, such that each is delineated only by its associated through-hole 308. As will be discussed below, each reception area 306 is provided at a location corresponding to an installed position of a designated spring clip 400.

Only select heating elements 108 of the cooktop 104 are shown in FIG. 2, namely a warmer element 108*a* and a radiant element 108*b*. It is to be understood that the heating elements 108 may be any other type of heating element generally known (e.g., induction heating elements, etc.) that is or can be undermounted beneath the cooktop plate 200. As illustrated, the radiant element 108*b* is an assembly that includes a conventional radiant heating element, for example an electric resistive element (e.g., a wire) wound in a pattern and seated within a ceramic housing. The warmer element 108*a* as illustrated includes an electric resistive element (e.g., a sheet or wire) that is disposed on a support surface. During operation, the radiant element 108*b* is configured to provide a higher heating output than that of the warmer element 108*a* (which is generally a low-wattage heating element).

Briefly moving back to FIG. 1, the warmer element 108*a* typically is located at a generally central position at the rear of the cooktop 104 such that a user need only slide a cooking vessel from an adjacent radiant cooking zone to the warming zone heated by the warmer element to continue heating the cooking vessel at a lower heating output—i.e., to keep-warm food after it has been cooked in an adjacent radiant heating zone. However, it is contemplated that the warmer element 108*a* may be disposed at any position.

In an assembled state, as will be further discussed below, the cooktop plate 200 is fitted over the support box 300 in order to enclose a space 'S' (shown in FIG. 5B) defined therebetween. The heating elements 108 are disposed within the space 'S' and are geo-located (i.e., disposed at a predetermined location on the cooktop surface based on the spring clips 400 engaging with their corresponding through-holes 308) and secured to the support box 300 by the spring clips 400. Each heating element 108 (i.e., the warmer element 108*a* and the radiant element 108*b*) is secured to the support box 300 and supported thereon preferably by at least two spring clips 400 (shown in FIG. 2). However, it is contemplated that any number of spring clips 400 may be used to locate and secure a heating element 108 to the support box 300.

Figure 3:
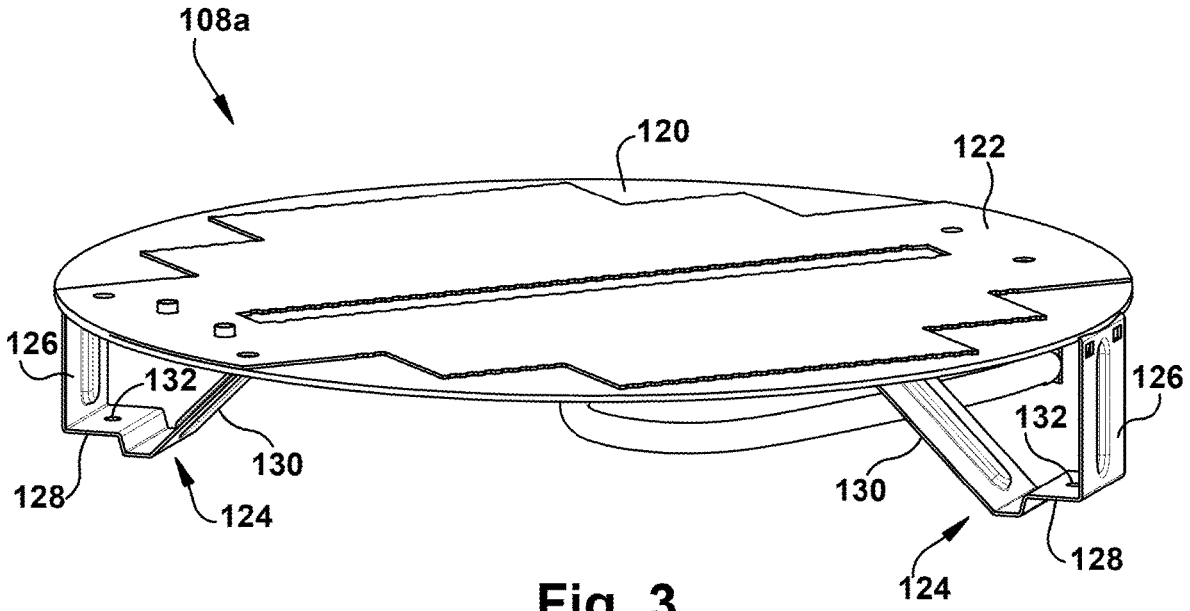
FIG. 3 is a perspective view of the warmer element, shown in FIG. 2.

Moving on to FIG. 3, the warmer element 108*a* is shown in a perspective view. The warmer element 108*a* is provided as an assembly that includes a support disk 120 with an electric resistive element 122 disposed on a surface thereof. The electric resistive element 122 is configured to be electrically connected to a power supply (not shown) to permit a current to pass therethrough in order for the warmer element 108*a* to emit a heating output (relatively lower than a heating output of a radiant element 108*b*). The electric resistive element 122 may be in a form of a sheet with an embedded resistive wire, e.g. following a serpentine path; or it may be a coiled resistance wire or a wire wound or disposed in any suitable configuration on the support disk 120.

As further shown, the warmer element 108*a* includes a plurality of support brackets 124 disposed adjacent a peripheral edge of the support disk 120 and extending downward therefrom in a direction opposite the upper surface of the support disk 120 on which the electric resistive element 122 is seated. While the example shown in FIG. 3 depicts only two support brackets 124, it is to be understood that the warmer element 108*a* may have any number of support brackets 124. The support brackets 124 can be formed integral with the support disk 120, wherein the support brackets 124 and the support disk 120 are initially formed into a single-piece, planar member (e.g., via stamping) wherein the support brackets 124 are subsequently bent from the support disk 120 into a desired shape. Alternatively, the support brackets 124 may be formed separate and distinct from the support disk 120 and subsequently secured thereto via fasteners, a suitable adhesive, or staking.

Each support bracket 124 includes a first brace 126, a second brace 128, and a third brace 130 (all formed integrally, together with the support disk 120). The first brace 126 extends vertically downward from the support disk 120 (substantially perpendicular thereto) toward the second brace 128. The second brace 128 is substantially parallel to the support disk 120 and extends radially inwards from the lower terminal end of the first brace 126 toward the third brace 130. The third brace 130 also extends radially inward but at an inclined angle from the second brace 128, until it reaches an underside of the support disk 120 where it is secured. As shown, the second brace 128 includes a step-down section that forms a junction with the third brace 130. However, it is contemplated that the second brace 128 need not have the step-down section; rather, the second brace 128 may be substantially planar. Moreover, an aperture 132 (i.e., a through-hole) is formed in the second brace 128 and is configured to receive a tab of the spring clip 400 in order to secure the spring clip 400 to the warmer element 108*a*, as will be further discussed below.

Figure 4A:
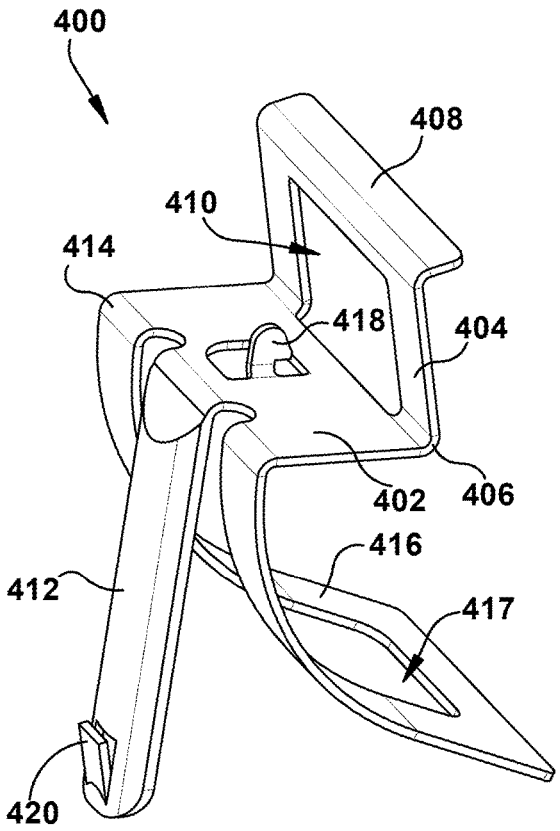
FIG. 4A is a perspective view of a spring clip as disclosed herein.
Figure 4B:
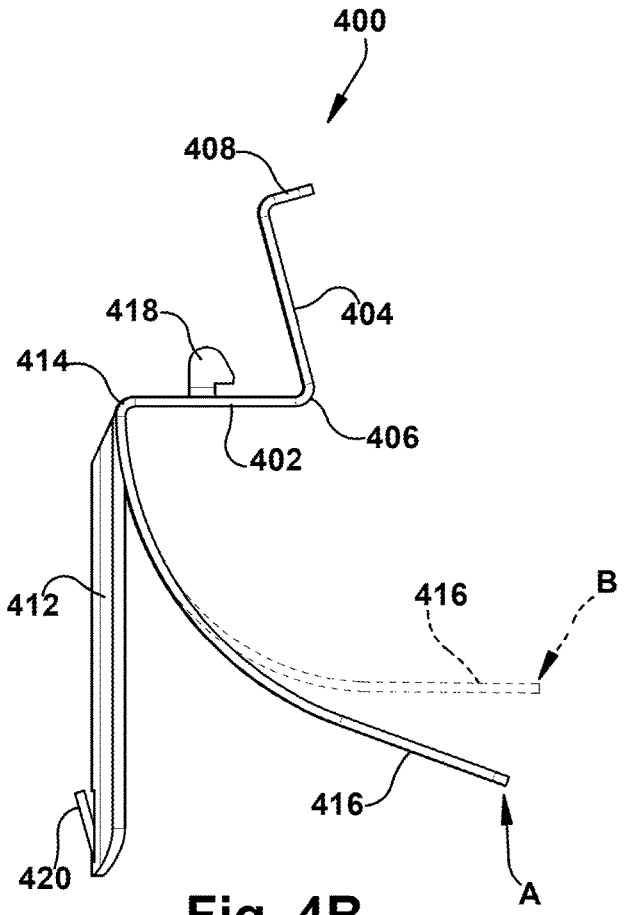
FIG. 4B is a side view of the spring clip shown in FIG. 4A.

Now moving on to FIGS. 4A and 4B, the spring clip 400 is shown in a perspective view and a side view, respectively. The spring clip 400 includes a generally planar seat portion 402, which in the illustrated embodiment has a rectangular shape. A first tab 404 extends upward from the seat portion 402 at an edge thereof, defining a first junction 406 therebetween. The first tab 404 extends (vertically upwards) from the seat portion 402 such that an acute angle is formed therebetween at the first junction 406 (best seen in FIG. 4B). However, in less preferred embodiments the first tab 404 may be perpendicular to the seat portion 402 or even have an angle therebetween that is obtuse. A distal flange 408 of the first tab 404 is substantially perpendicular therewith and extends in a direction outwards and away from the seat portion 402, such that the first tab 404 has a substantially "S"-shaped configuration when viewed from the side (seen in FIG. 4B) from the distal flange 408 through the first junction 406. As will be discussed below, the distal flange 408 provides a grasping point of the spring clip 400 during assembly thereof. A through-opening 410 can be formed in the first tab 404. However, it is contemplated that the first tab 404 need not include this through-opening 410 and instead can be provided as a continuous sheet.

A second tab 412 extends downward from the seat portion 402, from an edge thereof opposite the first junction 406, thereby defining a second junction 414 between the seat portion 402 and the second tab 412. That is, the first and second tabs 404, 412 extend from opposite edges of the seat portion 402, at opposite first and second junctions 406, 414, respectively. As shown, the second tab extends (vertically downwards) from the seat portion 402 in direction opposite that of the first tab 404, and in a generally perpendicular manner. However, it is contemplated that an angle formed between the seat portion 402 and the second tab 412 may be acute or obtuse.

As further shown, a spring tab 416 also extends downward from the seat portion 402, from the same edge thereof that defines the second junction 414. That is, the second tab 412 and the spring tab 416 both extend from the seat portion 402 and from a common second (substantially linear) junction 414 therewith. The spring tab 416 extends vertically downwards as noted, and also is curved away from the second tab 412 so the spring tab 416 proceeds generally underneath the seat portion 402 such that a terminal end thereof approaches or even extends beyond an imaginary plane defined by the first tab 404 (as seen best in FIG. 4B). Moreover, another through-opening 417 can be formed in the spring tab 416 as-shown, such that like the first tab 404, the spring tab 416 has the configuration of a frame defining an opening (i.e. a window) therein.

The spring tab 416 possesses a resting (i.e. elastically unstressed) orientation 'A,' but is bendable into a different, e.g. seated orientation 'B' when external forces act on the spring tab 416 in order to deflect it elastically into orientation 'B' against its bias toward the resting orientation 'A.' As shown, the resting and seated orientations 'A' and 'B' of the spring tab 416 have respective radii of curvature, wherein the radius of curvature of the resting orientation 'A' of the spring tab 416 is larger than that of the seated orientation 'B' of the spring tab 416.

A first retention arm 418 (which can be in the form of a detent or hook) stands proud from the upper surface of the seat portion 402, in the same general direction as the first tab 404 (i.e., vertically upwards). As will be further discussed, when used to secure a warming element 108*a* as discussed herein, the first retention arm 418 is configured to be received within the aperture 132 formed in the second brace 128 in order to secure the spring clip 400 to a corresponding one of the support brackets 124. Alternatively, when used to secure a radiant element 108*b* as discussed herein, a comparable opening or recess can be provided in a base wall of the ceramic housing of the radiant element 108*b* in order to accommodate the first retention arm 418, so as to secure the radiant element 108*b* similarly as described here for the warmer element 108*a*.

A second retention arm 420 (e.g. in the form of a hook or a detent) projects from the second tab 412 (preferably at an acute angle) at a distal end thereof. The second tab 412 is configured to be received through a through-hole 308 of a corresponding reception area 306 in the bottom wall 302 of the support box 300 as described above, such that the second retention arm 420 is advanced beyond that through-hole 308 and will be effective to secure the second tab 412 therein and against removal. In this manner, when installed the spring clip 400 (as well as the heating element 108 to which it is secured) will be appropriately geo-located within the cooktop 104 relative to the bottom wall 302, and secured thereto.

Assembly of the aforementioned cooktop 104 utilizing the spring clip 400 will now be discussed. It is to be understood that the below detailed steps are only an example of assembly, and that said steps need not occur in the specified order or in the exact manner. Furthermore, the below disclosure relates to securement of a warmer element 108*a* (via its support bracket 124). It is to be understood that the following description likewise applies to securement of a radiant element 108*b* as described above, or to any other undermount element or feature that is to be geo-located in and secured to the support box 300 beneath the cooktop plate 200 of the cooktop 104. In such instances, the radiant element 108*b* (or other undermount element) can be provided with comparable openings and perimeter walls as appropriate to engage with the spring clip 400 in a similar manner as discussed below.

Now with reference to FIG. 5A, the cooktop 104 is shown (in cross-section) in a partially assembled state, wherein the warmer element 108*a* is in a pre-affixed position relative to the support box 300, as will be discussed further below. Initially, the spring clip 400 is attached to a corresponding support bracket 124 of the warmer element 108*a*. Specifically, the spring clip 400 is located beneath the support bracket 124 and oriented such that the first retention arm 418 is aligned (i.e., coaxial) with the aperture 132 formed in the second brace 128. Thereafter, the spring clip 400 is seated on the support bracket 124 such that the seat portion 402 of the spring clip 400 physically contacts and abuttingly seats the second brace 128 of the support bracket 124, and the first retention arm 418 is received through the aperture 132, preferably in a manner that engages against the seat portion 402 (e.g. via snapping into place thereagainst). As further shown, when installed the first tab 404 of the spring clip 400 extends along and resiliently engages the first brace 126, adjacent to where the distal flange 408 depends from the first tab 404. Accordingly, it will be appreciated that in order to align the first retention arm 418 with the aperture 132 so that the spring clip 400 can be properly seated, the first tab 404 thereof may have to be deflected radially outward from a resting orientation, resiliently pivoting from the first junction 406. The return bias of the first tab 404 acts against the first brace 126 thus urging the seat portion 402 radially outward, which can aid in snapping the first retention arm 418 into engagement with the second brace 128 once it has penetrated fully through the aperture 132. More simply, the return bias of the first tab 404 and a detent or hook configuration of the first retention arm 418 together cooperate to secure the spring clip 400 in place and in resilient engagement with the warmer element 108*a* (i.e. with its support bracket 124).

As noted above, the distal flange 408 provides a grasping point of the spring clip 400 during assembly. That is, during an automated assembly process, a robot can grasp the spring clip 400 at the distal flange 408 in order to move the spring clip 400 into position and secure it to the support bracket 124, in the manner described above. Having a designated, predetermined grasping point on the spring clip 400 increases overall efficiency of the assembly process, especially if automation is employed.

With the spring clip 400 (or a plurality thereof) attached to the warmer element 108*a*, that warmer element 108*a* is then disposed above the bottom wall 302 of the support box 300 such that the second tab(s) 412 of the installed spring clip(s) 400 is/are aligned with the corresponding through-hole(s) 308 formed in the bottom wall 302 (i.e., at the associated reception area(s) 306). Thereafter, the warmer element 108*a* is moved linearly downward into seated engagement with the bottom wall 302 of the support box 300 as the second tab(s) 412 of the spring clip(s) 400 penetrate and are received through the corresponding through-hole(s) 308 in the bottom wall 302 of the support box 300.

As noted above, the reception areas 306, and more particularly their recessed geometries, simplify installation of the warmer element 108*a* with respect to the support box 300. For example, as shown in FIG. 5A, the reception area 306 has a concaved recess. Thus, the inclined nature of the reception area 306 facilitates alignment of the second tab 412 of the associated spring clip 400 with respect to the through-hole 308. That is, even if the second tab 412 of the spring clip 400 is initially slightly misaligned on approaching the through-hole 308, so long as the distal end of the second tab 412 contacts the inclined surface of the recess (during installation), then the second tab 412 will be guided into alignment with the through-hole 308 for proper securement of the spring clip 400.

More specifically, the distal end of the second tab 412 is advanced downward through the through-hole 308 (as shown in FIG. 5A) until the second retention arm 420 arrives at a location beneath the bottom wall 302. At the same time, such advancement of the second tab 412 results in a deflection of the spring tab 416 against the bottom wall 302 from its resting orientation 'A' to a seated orientation 'B.' This deflection of the spring tab 416 causes the spring clip 400 to resist the downward advancement by which the second tab 412 penetrates through the through-hole 308 in the bottom wall 302 of support box 300. Yet the spring clip 400 (and its associated warmer element 108*a*) is advanced in this manner, which simultaneously deflects the spring tab 416 from its resting orientation 'A' and delivers the second retention arm 420 to a location beneath the bottom wall 302, whereupon the second retention arm 420 re-expands or snaps radially in order to provide a locking detent that will resist or prevent withdrawal of the second tab 412 from the through-hole 308.

When the warmer element 108*a* (via its spring clip(s) 400) is seated on the bottom wall 302 of the support box 300, the spring clip(s) 400, and more particularly the spring tab(s) 416, bias(es) the warmer element 108*a* (vertically upwards) until the second retention arm 420 engages the underside of the bottom wall 302 and inhibits further vertical movement. As will be appreciated, in this manner, the spring clip(s) 400 (and its/their spring tab(s) 416) resiliently support the warmer element 108*a* at a spacing above the bottom wall 302. That is, when a plurality of such spring clips 400 are used for a particular heating element 108, their second tabs 412 cooperate with the associated through openings 308 in the bottom wall 302 in order to constrain the heating element 108 to linear vertical movement bounded essentially by the length of the second tabs 412. At the same time, their spring tabs 416 resiliently support the weight of the heating element 108 so that the heating element 108 is free to move vertically (but not laterally) constrained by the length of the second tabs 412, but is biased upward and away from the bottom wall 302 by the spring tabs 416. In a resting configuration, the heating element 108 can be spaced a first spaced distance D1 from the bottom wall 302 of the support box 300 as seen in FIG. 5A.

Moving now to FIG. 5B, the cooktop 104 is shown (in cross-section) in a fully assembled state, wherein the warmer element 108*a* has been pressed downward from above (by the cooktop plate 200) against the bias of the spring tab(s) 416 of the spring clips 400, until the cooktop plate 200 has been seated and the spring tab(s) 416 has/have arrived at the seated orientation 'B.' Specifically, after the warmer element 108*a* with the spring clip(s) 400 is seated onto the bottom wall 302 of the support box 300, the cooktop plate 200 is arranged above the support box 300 and pressed downward to assemble the cooktop 104. As the cooktop plate 200 is pressed downward, the underside surface 204 of the cooktop plate 200 physically contacts the heating element 108 and drives it vertically downwards (i.e., towards the bottom wall 302) against the bias of the spring tab(s) 416. That is, the force acting on the warmer element 108*a* (via the cooktop plate 200) during installation of the cooktop plate 200 overcomes the biasing force of the spring tab(s) 416, thereby causing the spring tab(s) 416 to bend further away from the resting orientation 'A' until the cooktop plate 200 is finally seated and the spring tab(s) 416 has/have reached the final seated orientation 'B,' as shown in FIG. 5B.

Thus, when the cooktop plate 200 is fully seated above the support box 300, the spring clip(s) 400, and more particularly the spring tab(s) 416 thereof bias(es) the warmer element 108*a* vertically upwards so that the warmer element 108*a* (and more specifically, the electric resistive element 122 thereof) is pressed in direct engagement (i.e., physical contact) with the underside surface 204 of the cooktop plate 200 with the spacing between the warmer element 108*a* (e.g., the support bracket 124) and the bottom wall 302 being reduced to a second spaced distance D2, smaller than the first spaced distance D1.

In sum, to install a heating element 108 (e.g., the warmer element 108*a*) in a cooktop 104, the heating element 108 is fitted with one or more spring clips 400, and initially is geo-located and aligned above the bottom wall 302 of the support box 300 such that the second tab(s) 412 of the spring clip(s) 400 is/are aligned with the associated through-holes 308 in the bottom wall 302. Then the heating element 108 is pressed downward, driving the second tab(s) 412 through the associated through-hole(s) 308 against the bias of the spring clip(s) 416 until the second retention arm(s) 420 arrive at the underside of the bottom wall 302. Thereafter, the cooktop plate 200 is seated from above and presses against the heating element 108, downward toward the bottom wall 302 of the support box 300, with enough force to overcome the inherent biasing force of the spring tab(s) 416, thus translating the heating element 108 into a final seated position, such that it is pressed upward against the underside surface 204 of the cooktop plate 200 via the spring tab(s) 416 acting against the bottom wall 302. The spring tab(s) 416 continue(s) to supply an upwards biasing force, urging the heating element 108 upwards towards the cooktop plate 200, thereby ensuring that intimate contact between heating element 108 and the cooktop plate 200 is maintained.

The above-described spring clip 400 requires no separate securing element (e.g., screws, bolts, rivets, etc.) to be secured in place with respect to both the heating element 108 and the support box 300. In the case of the warmer element 108*a* as described, it can be fitted with a bracket 124 having appropriate openings and other geometry to facilitate securement of the spring clip 400 via the cooperative action between the first retention arm 418 of the seating portion 402 and the resilient first tab 404 thereof. Analogously, when a radiant warmer element 108*b* is used, the required opening (comparable to the aperture 132) can be formed as a recess in the underside wall of the ceramic housing of the element 108*b*, whereas the first tab 404 can press against the circumferential wall thereof. Other undermount features can be provided with comparable cooperative structure to facilitate securement of the spring clip 400. Thus, the aforementioned design eliminates the need for separate fasteners, allowing the spring clip 400 to be connected more efficiently (during assembly) via only compressive forces. Moreover, once the spring clip 400 has been affixed to the undermount feature (such as a heating element 108), final assembly and affixation with the cooktop 104 involves compressing only along a single, assembly axis (e.g. the axis along which the warmer element 108*a* is compressed between the cooktop plate 200 and the bottom wall 302 of the support box 300 in the illustrated embodiment). Consequently, the resulting simple, single-axis assembly, without the need for additional fasteners, aids the assembly process, and especially one employing automation, because a robot need only compress the aligned elements together along a single axis to achieve assembly.

The invention has been described with reference to example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. A spring clip for securing a heating element in a cooktop, the spring clip comprising:

a seat portion configured to support the heating element thereon;

a first tab extending upward from the seat portion from a first junction therewith;

a second tab extending vertically downward from the seat portion from a second junction therewith located remote from the first junction; and a spring tab extending downward from the seat portion at a location remote from the first junction, and being elastically biased to a resting orientation, the spring tab being deflectable upward from said resting orientation upon engagement of said spring clip against a wall below the spring clip.

2. The spring clip of claim 1, the spring tab being curved and having a first radius of curvature in said resting orientation, the spring tab assuming a second radius of curvature smaller than said first radius of curvature upon being deflected upward against the bias of the spring tab.

3. The spring clip of claim 1, further comprising a first retention arm projecting from the seat portion, the first retention arm being configured to secure the spring clip to the heating element when seated against said seat portion.

4. The spring clip of claim 3, further comprising a second retention arm projecting from a distal end of the second tab, the second retention arm being configured to secure the spring clip to the wall.

5. The spring clip of claim 1, the first tab having a distal flange extending therefrom.

6. The spring clip of claim 1, wherein the spring tab is configured to press against the wall below the spring clip to bias the heating element away from said wall when installed.

7. The spring clip of claim 1, the first tab forming an acute angle with the seat portion in a resting orientation thereof, said first tab being resiliently pivotable from said first junction to thereby deflect the first tab from said resting orientation of the first tab against a bias thereof, in order to install the spring clip to said heating element.

8. The spring clip of claim 1, wherein said location is the second junction.

9. A cooktop comprising:

a cooktop plate having upper and underside surfaces, the upper surface being configured to support a cooking vessel thereon;

a support box disposed below the cooktop plate and having a bottom wall;

a heating element positioned between the cooktop plate and the bottom wall of the support box; and a spring clip biasing the heating element upward against the underside surface of the cooktop plate, the spring clip comprising:

a seat portion on which the heating element is seated;

a first tab extending upward from the seat portion from a first junction therewith;

a second tab extending vertically downward from the seat portion from a second junction therewith located remote from said first junction; and a spring tab extending downward from the seat portion and pressing against a top surface of the bottom wall of the support box thereby biasing the heating element into contact with the underside surface of the cooktop plate.

10. The cooktop appliance of claim 9, the heating element comprising a support disk having an electric resistive element disposed thereon, and a support bracket extending from the support disk and having first and second braces.

11. The cooktop appliance of claim 10, wherein the second brace of the support bracket rests on the seat portion of the spring clip, and wherein the first tab of the spring clip resiliently engages the first brace such that the first tab is biased laterally against the heating element.

12. The cooktop appliance of claim 10, the spring clip further comprising a retention arm projecting from the seat portion, the retention arm being configured to be received within an aperture formed in the second brace of the support bracket to secure the spring clip to the heating element when seated against said seat portion.

13. The cooktop appliance of claim 9, wherein a through-hole is formed in the bottom wall of the support box, and wherein a distal end of the second tab is received within the through-hole.

14. The cooktop appliance of claim 13, the spring clip further comprising a retention arm projecting from the distal end of the second tab, the retention arm being configured to secure the spring clip to the support box.

15. The cooktop appliance of claim 13, wherein the through-hole is formed in a reception area of the bottom wall formed as a recess of the bottom wall with said through-hole at a center of said reception area, and wherein the reception area is configured to guide alignment of the second tab with the through-hole during installation of the heating element.

16. The cooktop appliance of claim 9, wherein a length of said second tab defines a degree of permissible vertical movement of the heating element, once installed to the bottom wall of the support box.

17. The cooktop appliance of claim 9, wherein a vertical orientation of said second tab facilitates single-axis assembly of said heating element, affixed to said spring clip, to said bottom wall of the support box.

18. The cooktop appliance of claim 9, wherein said spring tab extends downward from said seat portion at a location remote from the first junction.

19. A spring clip for securing a heating element in a cooktop, the spring clip comprising:

a seat portion configured to support the heating element thereon;

a first tab extending upward from the seat portion from a first junction therewith, the first tab forming an acute angle with the seat portion in a resting orientation thereof, said first tab being resiliently pivotable from said first junction to thereby deflect the first tab from said resting orientation of the first tab against a bias thereof, in order to install the spring clip to said heating element;

a second tab extending vertically downward from the seat portion from a second junction therewith located remote from the first junction;

a first retention arm projecting from the seat portion, the first retention arm being configured to secure the spring clip to the heating element when seated against said seat portion;

a second retention arm projecting from a distal end of the second tab, the second retention arm being configured to secure the spring clip to a wall below the spring clip, wherein a length of said second tab defines a degree of permissible vertical movement of the spring clip, and thereby of the heating element, once installed to said wall, and wherein a vertical orientation of said second tab facilitates single-axis assembly of said heating element, affixed to said spring clip, to said wall beneath the spring clip; and a spring tab extending downward from the seat portion and being elastically biased to a resting orientation thereof, the spring tab being deflectable upward from said resting orientation of the spring tab upon engagement against the wall below the spring clip.

20. The spring clip of claim 19, the spring tab being curved away from the second tab such that the spring tab extends underneath the seat portion, the spring tab having a first radius of curvature in said resting orientation, the spring tab assuming a second radius of curvature smaller than said first radius of curvature upon being deflected upward against the bias of the spring tab upon engagement against said wall.

* * * * *